US007617995B2

(12) United States Patent
Florio

(10) Patent No.: US 7,617,995 B2
(45) Date of Patent: Nov. 17, 2009

(54) HOPPER GUN

(75) Inventor: Timothy Florio, Huntington Beach, CA (US)

(73) Assignee: Wallboard Tool Company, Inc., Long Beach, CA (US)

( * ) Notice: Subject to any disclaimer, the term of this patent is extended or adjusted under 35 U.S.C. 154(b) by 239 days.

(21) Appl. No.: 11/866,244

(22) Filed: Oct. 2, 2007

(65) Prior Publication Data

US 2009/0084871 A1 Apr. 2, 2009

(51) Int. Cl.
*B05B 7/30* (2006.01)

(52) U.S. Cl. ..... 239/346; 239/365; 239/369; 239/373; 239/376; 239/379; 239/583

(58) Field of Classification Search ..... 239/346, 239/365, 366, 369, 376, 373, 377, 379, 583
See application file for complete search history.

(56) References Cited

U.S. PATENT DOCUMENTS 2,497,625 A * 2/1950 Norwick ..... 239/417
5,232,161 A * 8/1993 Clemmons ..... 239/346
5,979,797 A * 11/1999 Castellano ..... 239/346

* cited by examiner

*Primary Examiner*—Dinh Q Nguyen
(74) *Attorney, Agent, or Firm*—Fulwider Patton LLP

(57) ABSTRACT

The present invention relates generally to an apparatus for applying texture materials to wall and ceiling surfaces, and more particularly to an improved hopper gun with an internal air control valve for controlling the on and off function of the atomizing air stream and an integrated flow control valve to manage the volume/pressure ratio of the pressurized atomizing air. The air control valve and flow control valve integrated into the improved hopper gun provides improved control over the texturing process and simplified operation of the improved hopper gun.

6 Claims, 2 Drawing Sheets

HOPPER GUN

BACKGROUND OF THE INVENTION

The present invention relates generally to an apparatus for applying texture materials to wall and ceiling surfaces, and more particularly to an improved hopper gun with an internal air control valve for controlling the on and off function of the atomizing air stream and an integrated flow control valve to manage the volume/pressure ratio of the pressurized atomizing air. The air control valve and flow control valve integrated into the improved hopper gun provides improved control over the texturing process and simplified operation of the improved hopper gun.

Hopper guns are well known in the art. U.S. Pat. No. 4,863,104 to Masterson teaches a spray gun for applying ceiling acoustic textures using compressed air. A method is described therein where material to be sprayed onto a surface is gradually mixed with a compressed stream of fast moving air. A reservoir above the gun holds the material to be applied, and the material drains before a nozzle that emits forced air, entraining the mixture and the air in a stream that is delivered to the intended surface. The invention disclosed in the Masterson patent was an improvement over prior art in both efficiency and reliability. U.S. Pat. No. 5,979,797 to Castellano discloses a hopper gun wherein a low pressure air supply is used to spray the material and also to force material out of the hopper in a reliable manner. U.S. Pat. No. 5,393,034 to Mendez discloses an air valve for a hopper gun having a male quick disconnect air inlet fitting that feeds pressurized air into an inlet end of a longitudinal rearwardly movable trigger actuated air stem for propelling texture coating mixture and the like onto a surface to be coated. The air shut off valve comprises a tubular valve stem disposed within the air stream of the hopper gun such that an open first end of the valve stem lies within the male quick disconnect air fitting proximal to the inlet aperture of the fitting. The fitting has at least one air inlet port through a wall thereof proximal the first end thereof. The teachings of the Masterson, Castellano, and Mendez patents are incorporated by reference herein in furtherance of the understanding of the present invention.

The prior art can effectively apply the texture materials to the intended surface, but improvements are still possible to make the devices more reliable and more efficient. One problem that occurs in prior art hopper guns is that they are typically equipped with a peripherally disposed non-integrated ball valve for controlling the on/off function of the pressurized atomizing air. The ball valve is generally located below the handle of or behind the hopper gun and requires manual rotary actuation. This is generally not convenient for the operator.

Additionally, during setup for the application process the volume/pressure ratio of the pressurized atomizing air needs to be managed to assist in achieving a desired texture pattern. Prior art hopper guns also required the ball valve to perform a dual role. In addition to performing its primary function of starting and stopping the flow of pressurized atomizing air through the hopper gun, the ball valve is also used for controlling the volume/pressure ratio of pressurized atomizing air. This means volume/pressure has to be readjusted each time the pressurized atomizing air is shut off. Restarting the pressurized atomizing air involves an adjustment of the handle of the ball valve to some undefined intermediate position.

Having to continually adjust and readjust (for example when refilling the hopper) the volume/pressure ratio during the application process without any defined parameters leads to inconsistencies in the texture pattern produced by the hopper gun. The present invention seeks to overcome this problem by integrating a dedicated flow control valve into body of the hopper gun that controls the volume/pressure ratio produced by the hopper gun. This feature is exclusive of the on/off function for the pressurized atomizing air stream allowing it to be set one time at the beginning of the application process and left at that setting for the duration of the application process.

SUMMARY OF THE INVENTION

The present invention is a hopper gun incorporating a design that allows for the successful inclusion of an integrated air control valve and a separate integrated airflow control valve. The unique design of the air control valve insures complete atomization of the texturing material. This is accomplished by initiating the pressurized atomizing air prior to its convergence with the texturing material. This involves the incorporation of several codependent components and is realized with a single initiation action. In the present invention's static state, a poppet is spring-biased against a poppet housing, closing off the pressurized atomizing air's discharge from the hopper gun. The trigger of the hopper gun has a tangent relationship to the sleeve housing of the air control valve. When the trigger is retracted to start the texturing process, the tangent relationship on the trigger engages the front face of the sleeve housing forcing the sleeve housing rearward. As the sleeve housing travels rearward, the sleeve housing's distal end abuts the poppet. The opposing force applied by the trigger overcomes the poppet's spring-biased position. This in turn moves the poppet rearward unseating the poppet from the poppet housing and allows the discharge of the pressurized atomizing air. Further retraction of the trigger causes the sleeve housing to abut a shoulder of the poppet housing.

The poppet housing, which is rigidly coupled to a compressed air stem through a threaded connection, moves rearward with the air stem. As the coupled poppet housing and air stem move rearward, the tip of the air stem unseats from the texture material orifice located at the front of the hopper gun. The unseating from the texture material orifice and rearward movement of the air stem allows the texture material to become entrained and aerated/atomized by the pre-existing pressurized atomizing air. The aerated/atomized texturing material is then discharged out of the hopper gun on to the surface being textured. When the trigger is released, the tip of the air stem reseats against the material orifice, which shuts off the texturing material prior to the poppet reseating against the poppet housing. This delay in shutting off the pressurized atomizing air until after the texturing material has been shut off insures complete aeration/atomization and discharge of the texturing material. The complete aeration/atomization of the texture material insures a consistent texture pattern throughout the entire application process.

An additional feature of the present invention is an airflow control valve that is integrated into the hopper gun. The airflow control valve is located on the hopper gun for convenience of the operator. The airflow control valve incorporates an orifice into its design. The orifice of the airflow control valve intersects an air passage of the hopper gun that communicates the pressurized atomizing air into the hopper gun. Rotary manipulation of an adjusting knob on the airflow control valve reorients the orifice's registration with the air passageway. This interaction between the air passageway and the orifice of the airflow control valve controls the flow of air from a completely unrestricted flow to a substantially restricted flow of pressurized atomizing air through the air passageway. This provides the user with a variable control of the volume/pressure ratio of the pressurized atomizing air as its supplied through the hopper gun. As a separate mechanism of the internal air control valve the flow control valve, the airflow control valve allows the volume/pressure ratio to be initialized to an appropriate level for the particular application at the start of the texturing process, and maintained in that state for the duration of the process or easily adjusted if a change in texture pattern is desired.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
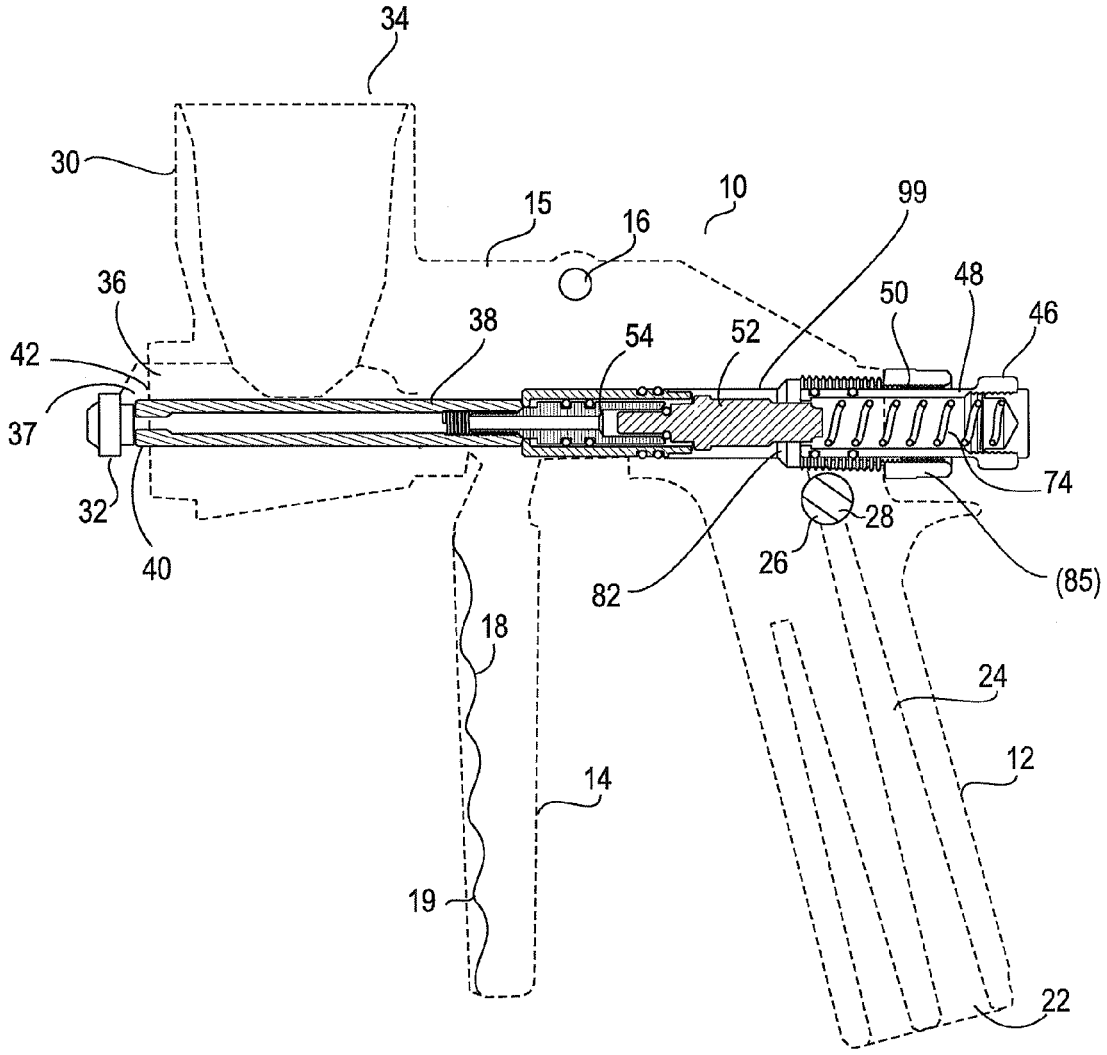
FIG. 1 is a side view, in cross section, of a first preferred embodiment of the present invention.

FIG. 1 illustrates the general features of the hopper gun 10 of the present invention, comprising a handle 12, a trigger 14, and a body portion 15. The trigger 14 is hinged to the body portion 15 of the gun 10 at pivot pin 16, as by a yoke section (not shown) that allows the trigger to pass over the body portion of the gun. The lower portion of the trigger 14 forms a finger grip 19 that is elongate and extends downward with recesses 18 on a front surface adapted to receive a portion of first, second, third, and fourth fingers to facilitate gripping and squeezing the trigger toward the handle 12. The finger grip 19 may be covered with a soft or resilient material to lessen stress on the fingers and provide some relief to users who may use the hopper gun 10 for many hours at a time. The mounting of the trigger 14 at pivot pin 16 allows the trigger to move between a forward position and a rearward position, which as explained more fully below controls the flow of air through the gun.

The handle 12 incorporates an air inlet 22. Air inlet 22 is preferably threaded, allowing the attachment of a variety of industry standard air hoses to hopper gun 10. The air hose (not shown) supplies the pressurized atomizing air necessary for aerating/atomizing the texture material. The pressurized atomizing air supplied by the air hose attached at air inlet 22 is directed into air passageway 24. Intersecting air passageway 24 is the airflow control valve 26 that incorporates a hollow orifice 28. A knob (not shown) of the airflow control valve can be rotated up to 90 degrees. This allows orifice 28 to be either completely aligned with air passageway 24, partially aligned with air passageway 24, or completely misaligned with air passageway 24. The degree of alignment or misalignment between orifice 28 and air passageway 24 determines the volume/pressure ratio produced by hopper gun 10. Consistently controlling the volume/pressure ratio is one of the factors that insures a repeatable texture pattern is produced by hopper gun 10.

Hopper gun 10 also includes a hopper boss 34 for attaching the hopper (not shown). The hopper is a generally funnel shaped container with a partial closure on the top surface and cylindrical opening on the bottom surface. The cylindrical opening at the bottom of the hopper is dimensionally compliant to the outside diameter of the hopper boss 34 and attached to the hopper gun 10 by means of a mechanical clamp (not shown). The hopper boss 34 is open ended at a top surface and defined by a generally cylindrical wall 30. The hopper allows storage of texture materials to be used during the application process. The texture material flows out of the hopper and through the hopper boss 34 to the staging chamber 36 via gravity. When the hopper gun 10 is in its static state as shown in FIG. 1, no texture material can pass through the material orifice 32. However, when trigger 14 is retracted, tip 40 of the air stem 38 unseats from the material orifice 32 and atomizing area 37 is exposed. The texture material flows into the atomizing area 37, where it converges with the pre-existing pressurized atomizing air. The texture material is aerated/atomized in atomizing area 37 then expelled from the hopper gun 10 through the material orifice 32 and on to the surface being textured.

Assuming the adjustable volume/pressure ratio of the pressurized atomizing air is constant, the lateral distance between tip 40 of the air stem 38 and material orifice 32 during the application process is one factor that determines the type of texture pattern produced. As tip 40 of air stem 38 moves laterally away from the material orifice 32, the amount of texture material in atomizing area 37 increases. The increased amount of texture material in atomizing area 37 changes the texture pattern produced by hopper gun 10. A higher ratio of texture material to pressurized atomizing air results in a heavier (larger) texture pattern and vice versa. To control the amount of lateral distance tip 40 of air stem 38 travels when trigger 14 is retracted, an adjustable stop 46 is incorporated into the hopper gun 10. In addition to acting as a positive stop, the adjustable stop 46 also houses spring 74. Spring 74 is spring-biased opposite the force applied when trigger 14 is retracted. When trigger 14 is in its static neutral state, spring 74 applies force to components of the integrated air control valve shutting off the pressurized atomizing air by seating o-ring 68 of poppet 52 against seat 70 of poppet housing 54, which further shuts off texture material from discharging out the front of hopper gun 10 by seating tip 40 of air stem 38 against material orifice 32. When trigger 14 is taken out of its static neutral state and retracted, it abuts face 82 of sleeve housing 66 causing sleeve housing 66 to move back along the cylindrical projection 59 of the poppet housing 54 until face 73 of sleeve housing 66 abuts shoulder 86 of poppet 52.

Continued rearward retraction of trigger 14 overcomes the existing spring biased condition produced by spring 74, and unseats o-ring 68 of poppet 52 from seat 70 of poppet housing 54. This unseating of o-ring 68 allows the pressurized atomizing air to flow through air passage 56 of poppet housing 54 and air stem 38, through orifice 60, through material orifice 32 and out of the front of hopper gun 10. Air stem 38 is rigidly coupled to poppet housing 54 by a threaded male/female relationship. Continued retraction of trigger 14 causes the inside face 90 of sleeve housing 66 to abut face 94 of poppet housing 54 causing poppet housing 54 and air stem 38 to travel laterally rearward resulting in tip 40 of air stem 38 unseating from material orifice 32, creating atomizing area 37. Continued retraction of the trigger 14 results in chamfer 63 of poppet 52 abutting face 81 of adjustable stop 46. The abutment of chamfer 63 of poppet 52 and face 81 of adjustable stop 46 stops trigger 14 retraction and provides a positive control mechanism for establishing the distance between tip 40 of air stem 38 and material orifice 32 on a repeatable basis. Adjustable stop 46 also has a threaded relationship 50 with threaded bushing 85. Turning adjustable stop 46 either clockwise (forward) or counter-clockwise (rearward) results in the lateral displacement of face 81 of adjustable stop 46 and determines at what point chamfer 63 of poppet 52 abuts face 81 of adjustable stop 46.

The series of abutted relationships between trigger 14 sleeve housing 66 poppet housing 54 poppet 52 and adjustable stop 46 results in the ability to positively and repeatedly control the lateral distance between tip 40 of air stem 38 and material orifice 32 during the application process. The ability to control the distance between tip 40 of air stem 38 and material orifice 32 during the application process is one factor that insures a repeatable texture pattern.

Figure 2:
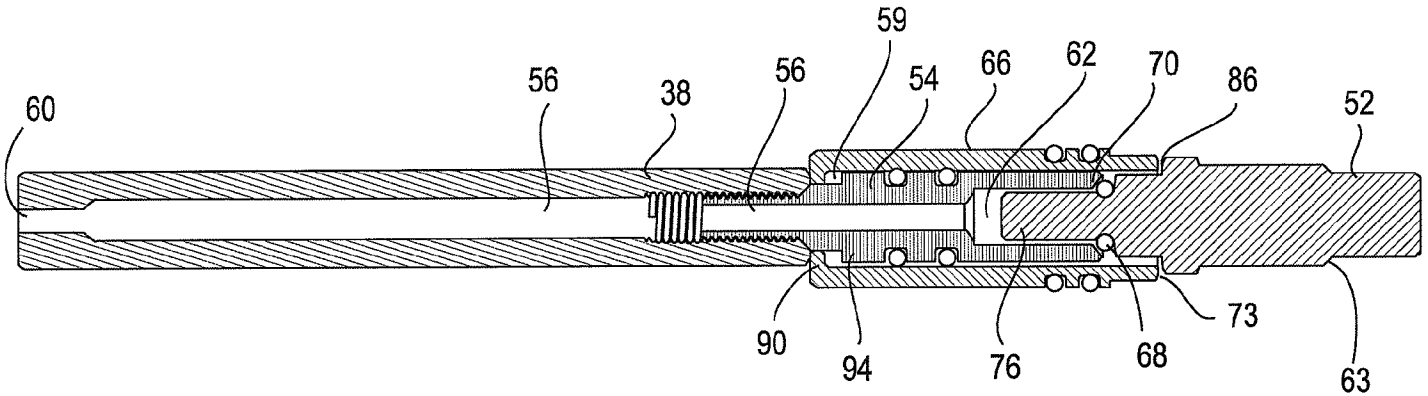
FIG. 2 is an enlarged, cross sectional view of the valve of the embodiment of FIG. 1 in the closed configuration.
Figure 3:
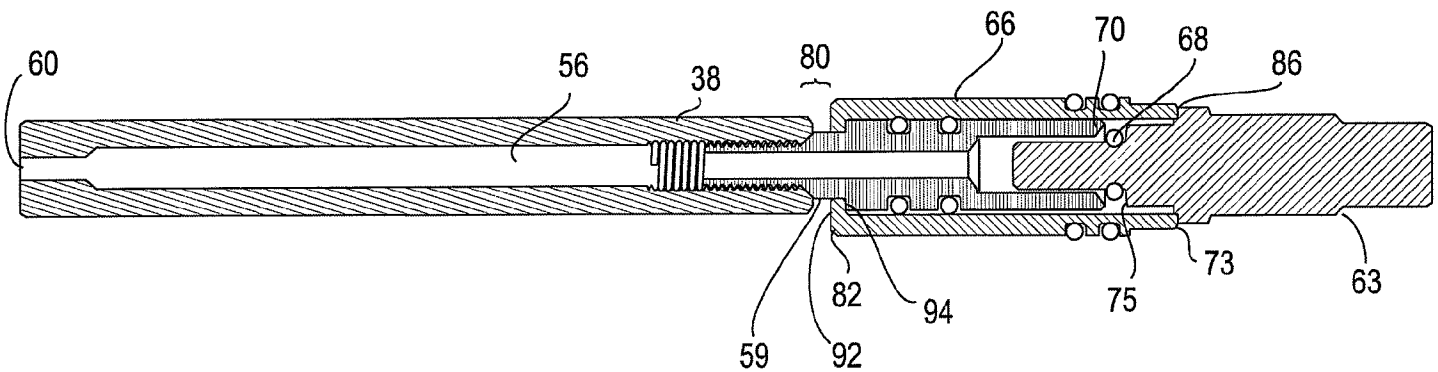
FIG. 3 is an enlarged, cross sectional view of the valve of the embodiment of FIG. 1 in the open configuration.

In FIGS. 2 and 3, the operation of the air valve structure is more clearly illustrated. When no retraction force is being applied to the trigger 14 of hopper gun 10 (FIG. 2), tip 40 of the air stem 38 abuts the material orifice 32, and atomizing area 37 is occluded by air stem 38. As set forth above, the air stem 38 is rigidly coupled to the poppet housing 54, by a threaded male/female relationship, with a common air passage 56 extending through both the poppet housing 54 and the air stem 38 until air passage 56 narrows at the distal end of air stem 38 resulting in air orifice 60 of air stem 38. At the proximal end of air passage 56 is receiver area 62 of the poppet housing 54. Receiver area 62 of poppet housing 54 accepts a cylindrical alignment projection 76 of the poppet 52. Since cylindrical alignment projection 76 of poppet 52 remains registered in receiver area 62 of poppet housing 54 at all times, poppet 52 can move laterally rearward unseating o-ring 68 of the poppet 52 from seat 70 of the poppet housing 54 without having poppet 52 become misaligned from poppet housing 54. When trigger 14 is in a neutral static state as represented in FIG. 1, the spring-biased condition produced by spring 70 forces the poppet 52 forward until o-ring 68 of the poppet 52 seats against seat 70 of the poppet housing 54. In this condition the sleeve housing 66 is also in a neutral state and the force is relieved between face 73 of the sleeve housing 66 and shoulder 86 of the poppet 52. With o-ring 68 of the poppet 52 seated against seat 70 of the poppet housing 54, the pressurized atomizing air is unable to enter air passage 56, the common air passage for poppet housing 54 and air stem 38. This condition (demonstrated in FIG. 2) effectively shuts off the pressurized atomizing air from being expelled through the front of the hopper gun 10.

Pressurized atomizing air entering hopper gun 10 at air inlet 22 flows through air passageway 24 until it encounters orifice 28 of flow control valve 26. The pressurized air is forced through orifice 28 of flow control valve 26, where its volume/pressure ratio is adjusted to the desired level. After passing through orifice 28 of flow control valve 26, the pressurized atomizing air flows into air staging area 99 and through two opposed cross-holes (not shown) located at the distal end of sleeve housing 66. With trigger 14 in its neutral static state as shown in FIG. 2, the pressurized atomizing air stream is restricted from entering receiver area 62. As the trigger 14 is retracted, a set of radius bosses on a yoke (not shown) of the trigger 14 abuts face 82 of sleeve housing 66 causing sleeve housing 66 to move laterally rearward along cylindrical portion 59 creating gap 80. As the sleeve housing 66 travels laterally away from air stem 38, the distal face 73 of the sleeve housing 66 abuts the shoulder 86 of the poppet 52 causing poppet 52 to move laterally away from poppet housing 54. As poppet 52 moves laterally away from poppet housing 54 the o-ring 68 of the poppet 52 unseats from seat 70 of the poppet housing 54 as shown in FIG. 3, creating an air passageway for the previously restricted pressurized atomizing air to enter the receiver area 62 at the proximal end of air passage 56. The pressurized atomizing air enters air passage 56 and is forced through air orifice 60, passing through material orifice 32 and is expelled from the front of hopper gun 10. However because air stem 38 has not moved, tip 40 of air stem 38 remains seated against material orifice 32 and texture material present in staging chamber 36 remains in a static state and is unable to flow into atomizing area 37.

Further retraction of trigger 14 results in face 90 of sleeve housing 66 abutting face 94 of poppet housing 54, forcing poppet housing 54 and air stem 38, which are rigidly coupled, to move laterally rearward unseating tip 40 of air stem 38 from material orifice 32. The unseating of tip 40 of air stem 38 from material orifice 32 allows texture material previously in a static state in staging chamber 36 to flow into atomizing area 37. Since the pressurized atomizing air is already established and discharging through orifice 60 of air stem 38 the texture material entering atomizing area 37 is aerated/atomized. The aerated/atomized texture material is then forced through material orifice 32 out of hopper gun 10 and on to the surface being textured. Complete retraction of trigger 14 is achieved when chamfer 63 of poppet 52 abuts face 81 of adjustable stop 46.

Releasing trigger 14 removes the force generated when trigger 14 is retracted and returns the spring-biased condition created by spring 74 to create a force. An additional force present in hopper gun 10 is that provided by the pressurized atomizing air. These two forces work in concert, systematically controlling the reversal of the abutted relationships created when trigger 14 is retracted. Spring 74 applies a lateral force to poppet 52, which moves poppet 52 forward while maintaining the pre-existing relationship between face 73 of sleeve housing 66 and shoulder 86 of poppet 52. The pressurized atomizing air's force interacts with interfering and restrictive surfaces of the poppet housing 66 and the air stem 38, forcing them forward. These separate but simultaneous forces allow tip 40 of air stem 38 the seat against material orifice 32, shutting off the flow of texture material prior to o-ring 68 of poppet 52 reseating against seat 70 of poppet housing 54. With the pressurized atomizing air still established, all of the texture material allowed into atomizing area 37, before it was occluded by air stem 38, is completely aerated/atomized. Poppet 52 continues to be forced laterally forward, which also forces sleeve housing 66 forward closing gap 80. When gap 80 is nearly closed, o-ring 68 of poppet 52 reseats itself against seat 70 of poppet housing 54, shutting off the flow of pressurized atomizing air through hopper gun 10.

From the foregoing, it can be seen that an initial retraction of trigger 14 of hopper gun 10 institutes a fully effective air flow through hopper gun 10, but no texture material can be aerated/atomize until trigger 14 is retracted further unseating tip 40 of air stem 38 from material orifice 32 and creating atomizing area 37. In atomizing area 37, the pre-existing pressurized atomizing air and the texture material are allowed to converge and the texture material is aerated/atomized. The aerated/atomized texture material is discharged from hopper gun 10 through material orifice 32 and on to the surface being textured. Inversely, when trigger 14 is released, tip 40 of air stem 38 moves laterally forward seating against material orifice 32 shutting off the discharge of texture material from hopper gun 10, but since o-ring 68 of poppet 52 hasn't seated against face 70 of popper housing 70, the pressurized atomized air continues to flow through hopper gun 10. The aforementioned pre-initiation of the pressurized atomizing air flow prior is convergence with the texture material when the trigger 14 is retracted, and the blocking of the texture material entering the staging area prior to shutting off the pressurized atomizing air when trigger 14 is released insures complete aeration/atomization of the texture material throughout the entire texturing process.

The foregoing description is intended to be illustrative of the concept of the present invention, but not limit the scope of the invention to the just described embodiments. Rather, one of ordinary skill in the art will readily appreciate that there are many modifications and substitutions that can be made to the operation of the air valve that will carry out the present invention, and said modifications and substitutions are intended to be incorporated into the scope of the invention. Therefore, the scope of the invention is intended to be limited only by the ordinary and customary meaning of the words and terms of the claims appended hereto.

I claim:

1. An improved hopper gun for delivering texturing materials to a surface, having a hopper for feeding texture material via a pathway to an atomizing area for expulsion through a material orifice, a port for coupling said hopper gun to a pressurized supply of air, a gun body including a handle and trigger for initiating airflow from the pressurized supply of air to the material orifice, comprising:

a cylindrical air stem disposed in said gun body, said cylindrical air stem having first and second ends and a channel extending longitudinally therein through, and said cylindrical air stem translating in said gun body between a first position occluding the pathway between the hopper and the atomizing area to foreclose texturing material from being expelled through said material orifice, and a second position recessed from first position to open the pathway allowing texturing material to enter said atomizing area and be expelled through said material orifice;

a poppet housing coupled to said cylindrical stem at a first end and having an air channel in communication with said channel in said cylindrical air stem;

a poppet biased against said poppet housing to close said air channel, said poppet retractable against said biasing to open said air channel and introduce air flow through said air channel; and a sleeve housing having first and second ends, said first end engaging with said poppet to open said air channel in response to an initial movement of said trigger, and said second end driving said cylindrical air stem to said second position in response to further movement of said trigger beyond said initial movement.

2. The improved hopper gun of claim 1 where the poppet includes an o-ring that engages with the poppet housing to close said air channel when said poppet is biased against said poppet housing.

3. The improved hopper gun of claim 1 where a gap exists between said sleeve housing and said cylindrical air stem when air is flowing through said air channel.

4. The improved hopper gun of claim 1 further comprising a control for setting the first position of said cylindrical air stem.

5. The improved hopper gun of claim 1 further comprising a control for regulating an air flow into said hopper gun.

6. The improved hopper gun of claim 1 wherein said biasing is established by a spring mounted in said hopper gun body and in contact with said poppet.

* * * * *